US011125232B2

(12) United States Patent
Murakami et al.

(10) Patent No.: US 11,125,232 B2
(45) Date of Patent: Sep. 21, 2021

(54) SCROLL COMPRESSOR WITH COVER MEMBER DEFINING REAR SURFACE ADJACENT SPACE

(71) Applicant: Daikin Industries, LTD., Osaka (JP)

(72) Inventors: Yasuhiro Murakami, Osaka (JP); Yasuo Mizushima, Osaka (JP); Ryouta Nakai, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/496,996

(22) PCT Filed: May 7, 2018

(86) PCT No.: PCT/JP2018/017665
§ 371 (c)(1),
(2) Date: Sep. 24, 2019

(87) PCT Pub. No.: WO2018/207743
PCT Pub. Date: Nov. 15, 2018

(65) Prior Publication Data

US 2020/0378384 A1 Dec. 3, 2020

(30) Foreign Application Priority Data

May 12, 2017 (JP) ..... JP2017-095611

(51) Int. Cl.
*F04C 18/02* (2006.01)
*F01C 1/02* (2006.01)
(Continued)

(52) U.S. Cl.
CPC ..... *F04C 18/0215* (2013.01)

(58) Field of Classification Search
CPC ..... F04C 18/0215; F04C 18/0253; F04C 18/0261; F04C 29/0021; F04C 29/02;
(Continued)

(56) References Cited

U.S. PATENT DOCUMENTS 5,186,616 A 2/1993 Hirano
7,736,135 B2 * 6/2010 Liang ..... F04C 18/0215 418/55.3
(Continued)

FOREIGN PATENT DOCUMENTS

JP 3-49390 U 5/1991
JP 4-66701 A 3/1992
(Continued)

OTHER PUBLICATIONS

International Search Report of corresponding PCT Application No. PCT/JP2018/017665 dated Jul. 31, 2018.
European Search Report of corresponding EP Application No. 18 798 095.8 dated Feb. 7, 2020.
International Preliminary Report of corresponding PCT Application No. PCT/JP2018/017665 dated Nov. 21, 2019.

*Primary Examiner* — Deming Wan
(74) *Attorney, Agent, or Firm* — Global IP Counselors, LLP

(57) ABSTRACT

Provided is an efficient scroll compressor capable of suppressing deformation of a fixed scroll during operation. The scroll compressor includes: a fixed scroll (30) including a fixed-side end plate (32) and a spiral fixed-side wrap (34) protruding from a front surface (32*a*) of the fixed-side end plate; a movable scroll (40) including a spiral movable-side wrap (44) combined with the fixed-side wrap to form a compression chamber (Sc); and a cover member (60) disposed in a high-pressure space on a rear surface (32*b*) side of the fixed-side end plate and attached to the fixed scroll. The fixed-side end plate includes a compression chamber adjacent portion (33) at which the front surface of the fixed-side end plate faces the compression chamber. The compression chamber adjacent portion includes a high-pressure adjacent portion (33*a*) disposed at a central portion of the compression chamber adjacent portion, and an intermediate- and low-pressure adjacent portion (33*b*). At the high-pressure adjacent portion, the front surface of the fixed-side end plate faces a high-pressure compression
(Continued)

chamber. The intermediate- and low-pressure adjacent portion is disposed on the outer side of the high-pressure adjacent portion. The cover member defines a low- or intermediate-pressure rear surface adjacent space (S3) that faces at least a part of a rear surface of the intermediate- and low-pressure adjacent portion in the compression chamber adjacent portion of the fixed-side end plate.

14 Claims, 6 Drawing Sheets

(51) Int. Cl.

| | |
|---|---|
| ***F04C 29/12*** | (2006.01) |
| ***F04C 29/02*** | (2006.01) |
| ***F04C 29/00*** | (2006.01) |
| ***F04C 28/26*** | (2006.01) |

(58) Field of Classification Search
CPC ..... F04C 28/26; F04C 23/026; F04C 29/042; F01C 1/0215; F01C 1/0246; F01C 1/0253
See application file for complete search history.

(56) References Cited

U.S. PATENT DOCUMENTS

| | | | | |
|---|---|---|---|---|
| 8,177,532 | B2 * | 5/2012 | Okaichi | F01C 11/008 418/3 |
| 9,243,636 | B2 | 1/2016 | Kim et al. | |
| 2013/0177465 | A1 | 7/2013 | Clendenin et al. | |
| 2013/0309118 | A1 * | 11/2013 | Ginies | F04C 18/0253 418/55.4 |
| 2014/0037485 | A1 * | 2/2014 | Schneider | F04C 18/0215 418/55.1 |
| 2018/0372103 | A1 * | 12/2018 | Choi | F04C 18/0215 |

FOREIGN PATENT DOCUMENTS

| | | | |
|---|---|---|---|
| JP | 5-22076 | B2 | 3/1993 |
| JP | 2560857 | B2 | 12/1996 |
| JP | 9-177683 | A | 7/1997 |
| JP | 2003-206873 | A | 7/2003 |

* cited by examiner

SCROLL COMPRESSOR WITH COVER MEMBER DEFINING REAR SURFACE ADJACENT SPACE

TECHNICAL FIELD

The present invention relates to a scroll compressor, and particularly to a scroll compressor in which, during operation, a high-pressure space is disposed on a rear surface side of an end plate of a fixed scroll (the side opposite to a surface from which a fixed-side wrap protrudes).

BACKGROUND ART

There is known a scroll compressor in which, during operation, a space that faces a rear surface of an end plate of a fixed scroll (the surface opposite to a front surface from which a fixed-side wrap protrudes) has a high pressure (discharge pressure).

In such a scroll compressor, as disclosed in, for example, Patent Literature 1 (JP 2003-206873 A), a rear surface of an end plate of a fixed scroll faces a space that has a high pressure during operation, over the entire region where a front surface of the end plate of the fixed scroll faces a compression chamber.

SUMMARY OF THE INVENTION

Technical Problem

During operation of the scroll compressor, a central part of the compression chamber that faces the end plate of the fixed scroll has a high pressure, but a space surrounding the central part has a low pressure (suction pressure) or an intermediate pressure (intermediate pressure between the suction pressure and the discharge pressure). Therefore, in the scroll compressor as disclosed in Patent Literature 1 (JP 2003-206873 A), high-pressure refrigerant acting on the rear surface of the end plate of the fixed scroll may push and deform the end plate toward the compression chamber having a low or intermediate pressure. When the end plate of the fixed scroll is deformed as described above, a gap between a distal end of a wrap of the fixed or movable scroll and the end plate of the movable or fixed scroll facing the distal end of the wrap (tip gap) may increase, or the tip gap may be non-uniform. This may reduce the efficiency of the scroll compressor.

An object of the present invention is to provide an efficient scroll compressor capable of reducing deformation of a fixed scroll during operation.

Solution to Problem

A scroll compressor according to a first aspect of the present invention includes a fixed scroll, a movable scroll, and a cover member. The fixed scroll includes a flat plate-shaped fixed-side end plate and a spiral fixed-side wrap protruding from a front surface of the fixed-side end plate. The movable scroll includes a flat plate-shaped movable-side end plate and a spiral movable-side wrap that protrudes from a front surface of the movable-side end plate and is combined with the fixed-side wrap to form a compression chamber. The cover member is disposed in a high-pressure space on a rear surface side of the fixed-side end plate, and is attached to the fixed scroll. The fixed-side end plate includes a compression chamber adjacent portion at which the front surface of the fixed-side end plate faces the compression chamber. The compression chamber adjacent portion includes a high-pressure adjacent portion disposed at a central portion of the compression chamber adjacent portion, and an intermediate- and low-pressure adjacent portion. At the high-pressure adjacent portion, the front surface of the fixed-side end plate faces a high-pressure compression chamber. The intermediate- and low-pressure adjacent portion is disposed on the outer side of the high-pressure adjacent portion. The cover member defines a low- or intermediate-pressure rear surface adjacent space that faces at least a part of a rear surface of the intermediate- and low-pressure adjacent portion in the compression chamber adjacent portion of the fixed-side end plate.

The low pressure here means a suction pressure of the scroll compressor during steady operation of the scroll compressor. The high pressure here means a discharge pressure of the scroll compressor during steady operation of the scroll compressor. The intermediate pressure here means a pressure between the low pressure and the high pressure.

Here, the high-pressure adjacent portion of the compression chamber adjacent portion means a portion of the compression chamber adjacent portion that faces the compression chamber whose pressure rises to the discharge pressure during steady operation of the scroll compressor. The intermediate- and low-pressure adjacent portion of the compression chamber adjacent portion means a portion of the compression chamber adjacent portion that faces the compression chamber whose pressure does not rise to the discharge pressure during steady operation of the scroll compressor (i.e., the compression chamber whose maximum pressure is a low or intermediate pressure).

In the scroll compressor, the cover member defines a low- or intermediate-pressure rear surface adjacent space that faces at least a part of a rear surface of the intermediate- and low-pressure adjacent portion (i.e., a portion of the compression chamber adjacent portion that faces a low- or intermediate-pressure compression chamber), among a rear surface of the compression chamber adjacent portion of the fixed-side end plate with the front surface facing the compression chamber. With such a configuration, the pressure difference between the front surface side and the rear surface side of the fixed-side end plate during operation of the scroll compressor is reduced. Therefore, the deformation of the fixed scroll is reduced and the efficient scroll compressor is implemented.

High-pressure refrigerant has a high temperature. Therefore, in the scroll compressor in which the entire rear surface of the compression chamber adjacent portion is adjacent to the high-pressure space, the heat in the high-pressure space is easily transferred to the refrigerant in the low- or intermediate-pressure compression chamber and compressed gas may be overheated. Due to such heat transfer from the high-pressure space to the low- or intermediate-pressure compression chamber, a gap between a distal end of the wrap of the fixed or movable scroll and the end plate of the movable or fixed scroll facing the distal end of the wrap of the fixed or movable scroll (tip gap) may be non-uniform. Meanwhile, in the scroll compressor, the low- or intermediate-pressure rear surface adjacent space is provided between the high-pressure space and the fixed-side end plate. This makes it possible to reduce occurrence of the above problems caused by the heat transfer from the high-pressure space to the low- or intermediate-pressure compression chamber.

A scroll compressor according to a second aspect of the present invention is the scroll compressor according to the first aspect, wherein the intermediate- and low-pressure adjacent portion includes a low-pressure adjacent portion at which the front surface of the fixed-side end plate faces the low-pressure compression chamber. The rear surface adjacent space faces at least a rear surface of the low-pressure adjacent portion.

Here, the low-pressure adjacent portion of the compression chamber adjacent portion means a portion of the compression chamber adjacent portion that faces the compression chamber whose pressure does not rise from the suction pressure during steady operation of the scroll compressor.

During steady operation of the scroll compressor according to the second aspect of the present invention, there is no portion in the fixed-side end plate where the front surface side has a low pressure and the rear surface side has a high pressure. Therefore, a relatively large deformation of the fixed scroll can be prevented. As a result, the efficient scroll compressor is implemented.

A scroll compressor according to a third aspect of the present invention is the scroll compressor according to the first or second aspect, wherein the intermediate- and low-pressure adjacent portion includes an intermediate-pressure adjacent portion at which the front surface of the fixed-side end plate faces the intermediate-pressure compression chamber. The rear surface adjacent space includes at least a low-pressure rear surface adjacent space having a low pressure. The low-pressure rear surface adjacent space is disposed on the outer side of the intermediate-pressure adjacent portion with reference to the central portion of the compression chamber adjacent portion.

Here, the intermediate-pressure adjacent portion of the compression chamber adjacent portion means a portion of the compression chamber adjacent portion that faces the compression chamber whose pressure rises above the suction pressure but does not reach the discharge pressure during steady operation of the scroll compressor. In other words, the intermediate-pressure adjacent portion of the compression chamber adjacent portion is a portion other than the high-pressure adjacent portion and the low-pressure adjacent portion of the compression chamber adjacent portion.

During steady operation of the scroll compressor according to the third aspect of the present invention, there is no portion in the fixed-side end plate where the front surface side has an intermediate pressure and the rear surface side has a low pressure. Therefore, the deformation of the fixed scroll can be prevented. As a result, the efficient scroll compressor is implemented.

A scroll compressor according to a fourth aspect of the present invention is the scroll compressor according to the first aspect, wherein the rear surface adjacent space includes a first rear surface adjacent space having an intermediate pressure and a second rear surface adjacent space having a low pressure. The second rear surface adjacent space is disposed on the outer side of the first rear surface adjacent space with reference to the central portion of the compression chamber adjacent portion.

As a common characteristic of a scroll compressor, a high-pressure compression chamber is disposed on the central side of the scroll, a low-pressure compression chamber is disposed on the outer side of the scroll, and an intermediate-pressure compression chamber is disposed between the high-pressure compression chamber and the low-pressure compression chamber. In the scroll compressor according to the fourth aspect of the present invention, the intermediate-pressure first rear surface adjacent space is disposed on the inner side and the low-pressure second rear surface adjacent space is disposed on the outer side with reference to the central portion of the compression chamber adjacent portion in accordance with the above pressure distribution. During steady operation of the scroll compressor, therefore, the pressure difference between the front surface side and the rear surface side of the fixed-side end plate is less likely to occur. As a result, the deformation of the fixed scroll is reduced and a highly efficient scroll compressor is implemented.

A scroll compressor according to a fifth aspect of the present invention is the scroll compressor according to the fourth aspect, wherein the intermediate- and low-pressure adjacent portion includes the low-pressure adjacent portion at which the front surface of the fixed-side end plate faces the low-pressure compression chamber, and the intermediate-pressure adjacent portion at which the front surface of the fixed-side end plate faces the compression chamber having an intermediate pressure. The first rear surface adjacent space faces a rear surface of the intermediate-pressure adjacent portion. The second rear surface adjacent space faces a rear surface of the low-pressure adjacent portion.

In the scroll compressor according to the fifth aspect of the present invention, the pressure on the front surface side and the pressure on the rear surface side are substantially equal throughout the compression chamber adjacent portion of the fixed-side end plate. Therefore, the deformation of the fixed scroll is particularly easily reduced and the efficient scroll compressor is implemented.

A scroll compressor according to a sixth aspect of the present invention is the scroll compressor according to any one of the first to fifth aspects, wherein the rear surface adjacent space has a volume smaller than a volume of the high-pressure space.

The scroll compressor according to the sixth aspect of the present invention is a highly efficient and compact scroll compressor capable of reducing the deformation of the fixed scroll.

A scroll compressor according to a seventh aspect of the present invention is the scroll compressor according to any one of the first to sixth aspects, wherein the cover member defines the rear surface adjacent space having an annular shape.

In the scroll compressor according to the seventh aspect of the present invention, the pressure difference between the front surface side and the rear surface side of the fixed-side end plate during steady operation of the scroll compressor can be reduced over the entire circumference. Therefore, a local deformation of the fixed scroll can be reduced.

A scroll compressor according to an eighth aspect of the present invention is the scroll compressor according to any one of the first to seventh aspects, further including an oil supply path through which oil having an intermediate pressure is supplied to the rear surface adjacent space. An oil passage is formed in the fixed-side end plate. The oil in the rear surface adjacent space is guided to the compression chamber through the oil passage.

In the scroll compressor according to the eighth aspect of the present invention, at least a part of the rear surface adjacent space is filled with the intermediate-pressure oil. Even when the operating condition changes, therefore, a sudden pressure change in the rear surface adjacent space can be reduced as compared to a case where the rear surface adjacent space only contains gas. Since the oil in the rear surface adjacent space is supplied to the compression chamber, the compression mechanism can reliably be lubricated, and the reliability and performance of the scroll compressor can be improved.

A scroll compressor according to a ninth aspect of the present invention is the scroll compressor according to any one of the first to eighth aspects, further including a relief valve. The relief valve is attached to the cover member to close a communication hole formed in the cover member. The high-pressure space communicates with the rear surface adjacent space through the communication hole. The relief valve opens when the pressure in the rear surface adjacent space rises above a predetermined pressure.

In the scroll compressor according to the ninth aspect of the present invention, even if the pressure in the rear surface adjacent space rises abnormally for some reason, the pressure can be released to the high-pressure space and the reliability of the scroll compressor can be secured.

Advantageous Effects of Invention

In the scroll compressor according to the present invention, the cover member defines the low- or intermediate-pressure rear surface adjacent space that faces at least a part of the rear surface of the intermediate- and low-pressure adjacent portion (i.e., a portion of the compression chamber adjacent portion that faces the low- or intermediate-pressure compression chamber), among the rear surface of the compression chamber adjacent portion of the fixed-side end plate with the front surface facing the compression chamber. With such a configuration, the pressure difference between the front surface side and the rear surface side of the fixed-side end plate during operation of the scroll compressor is reduced. Therefore, the deformation of the fixed scroll is reduced and the efficient scroll compressor is implemented.

BRIEF DESCRIPTION OF THE DRAWINGS

in FIG. 3, the fixed scroll as viewed from above is schematically drawn, and a fixed-side wrap and a movable scroll, which cannot be seen from above, are respectively drawn with a dotted line and a two-dot chain line.

DESCRIPTION OF EMBODIMENTS

A scroll compressor according to an embodiment of the present invention will be described with reference to the drawings.

The following embodiment is merely a specific example of the present invention, and the present invention is not limited to the embodiment. The following embodiment can appropriately be modified without departing from the scope of the present invention.

(1) Overall Configuration

Figure 1:
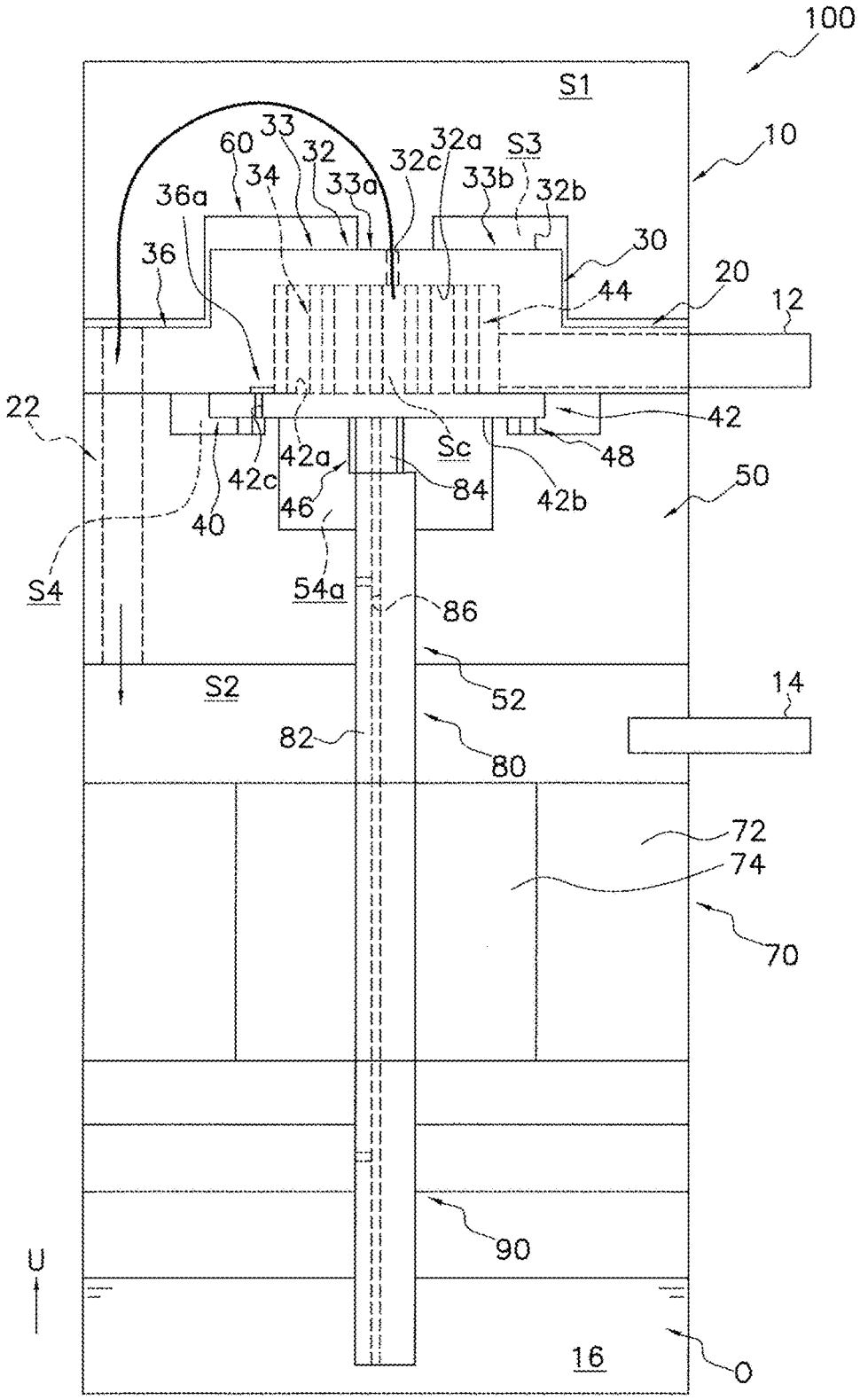
FIG. 1 is a schematic view of a scroll compressor according to an embodiment of the present invention.

A scroll compressor 100 according to an embodiment of the present invention will be described. FIG. 1 is a schematic view illustrating the scroll compressor 100.

The scroll compressor 100 is, for example, a refrigerant compressor used in a refrigeration apparatus. In the refrigeration apparatus, the scroll compressor 100 constitutes a refrigeration cycle together with a heat exchanger that functions as a refrigerant cooler (condenser), a heat exchanger that functions as a refrigerant heater (evaporator), and a refrigerant expansion mechanism, for example. Examples of the refrigeration apparatus include an air conditioner, a hot water supply system, and a dehumidifier.

In the following, the terms "low pressure", "high pressure", and "intermediate pressure" may be used to express a pressure. The low pressure here means a low pressure in the refrigeration cycle that includes the scroll compressor 100. The low pressure also means a suction pressure of the scroll compressor 100 during steady operation. The high pressure here means a high pressure in the refrigeration cycle that includes the scroll compressor 100. The high pressure also means a discharge pressure of the scroll compressor 100 during steady operation. The intermediate pressure here means an intermediate pressure between the low pressure (suction pressure) and the high pressure (discharge pressure).

Refrigerant to be compressed by the scroll compressor 100 is, for example, refrigerant that tends to have a high temperature and a high pressure by being compressed. In other words, the refrigerant to be compressed by the scroll compressor 100 has a relatively high condensation pressure.

In the scroll compressor 100, a first space S1 is formed on a rear surface side of a fixed scroll 30 of a compression mechanism 20 (the side not facing a movable scroll 40; the upper side in the present embodiment) (see FIG. 1). The refrigerant flows into the first space S1 after being discharged from the compression mechanism 20. As a result of using the refrigerant having a relatively high condensation pressure as exemplified in the present embodiment, the first space S1 tends to have a relatively high temperature and high pressure.

Specific examples of the refrigerant to be compressed by the scroll compressor 100 include R32 (R32 alone), mixed refrigerant containing R32 at 50% or more (e.g. R410A, R452B, and R454B), and mixed refrigerant of R1123 and R32. The refrigerant to be compressed by the scroll compressor 100 here is refrigerant having a higher condensation pressure than R410A, such as R32 and mixed refrigerant of R1123 and R32.

However, the refrigerant to be compressed by the scroll compressor 100 is not limited to the above-described refrigerant, but may alternatively be refrigerant having a relatively lower condensation pressure than the exemplified refrigerant.

As illustrated in FIG. 1, the scroll compressor 100 mainly includes a casing 10, the compression mechanism 20, a cover member 60, a motor 70, a crankshaft 80, and a lower bearing 90. The compression mechanism 20 mainly includes the fixed scroll 30, the movable scroll 40, and a housing 50 (see FIG. 1).

The scroll compressor 100 has a so-called high-pressure dome structure. The first space S1, a second space S2, an oil storage space 16, and a crank chamber 54*a* each have a high pressure during steady operation of the scroll compressor 100 (for example, in a state where the scroll compressor 100 has been operated for a relatively long time after the operation start with no change in operating conditions). The first space S1 is disposed above the fixed scroll 30. The refrigerant compressed by the compression mechanism 20 is discharged into the first space S1. The second space S2 is formed below the housing 50. The motor 70 is disposed in the second space S2. The first space S1 and the second space S2 communicate with each other through a refrigerant passage 22 that passes through the fixed scroll 30 and the housing 50 (see FIG. 1). The oil storage space 16 is formed in a lower part of the casing 10. Oil O (refrigeration oil) is stored in the oil storage space 16. The crank chamber 54*a* is formed by the housing 50. A boss 46, which will be described later, of the movable scroll 40 is disposed in the crank chamber 54*a*.

(2) Detailed Configuration

The configuration of the scroll compressor 100 will be described in detail below. In the following description, the direction of the arrow U in FIG. 1 is upward, unless otherwise specified.

(2-1) Casing

The scroll compressor 100 includes the vertically elongated cylindrical casing 10.

Although not illustrated, the casing 10 includes a cylindrical member opened at the top and bottom, and an upper lid and a lower lid provided respectively on the top and bottom of the cylindrical member. The cylindrical member and the upper and lower lids are fixed by welding to maintain airtightness.

As illustrated in FIG. 1, various components of the scroll compressor 100 including the compression mechanism 20, the cover member 60, the motor 70, the crankshaft 80, and the lower bearing 90 are accommodated in the casing 10. The oil storage space 16 is formed in the lower part of the casing 10 as illustrated in FIG. 1. The oil storage space 16 stores the oil O (refrigeration oil) for lubricating, for example, the compression mechanism 20. The oil storage space 16 communicates with the second space S2 formed below the housing 50 of the compression mechanism 20.

As illustrated in FIG. 1, a suction pipe 12 is provided at an upper part of the casing 10 while passing through a side surface of the casing 10. Gas refrigerant to be compressed by the compression mechanism 20 is sucked through the suction pipe 12. The suction pipe 12 is connected to the fixed scroll 30 of the compression mechanism 20. The suction pipe 12 communicates with a compression chamber Sc on an outer peripheral side of the compression mechanism 20 described later. Low-pressure refrigerant before being compressed by the scroll compressor 100 flows through the suction pipe 12.

A discharge pipe 14 is provided at a central part of the casing 10 in the vertical direction, as illustrated in FIG. 1. The gas refrigerant is discharged to the outside of the casing 10 through the discharge pipe 14. The discharge pipe 14 is attached to the side surface of the casing 10 such that one end of the discharge pipe 14 inside the casing 10 protrudes into the second space S2 formed below the housing 50 of the compression mechanism 20. In the scroll compressor 100, high-pressure refrigerant compressed by the compression mechanism 20 flows through the discharge pipe 14.

(2-2) Compression Mechanism

As illustrated in FIG. 1, the compression mechanism 20 mainly includes the fixed scroll 30, the movable scroll 40 combined with the fixed scroll 30 to form the compression chamber Sc, and the housing 50 disposed below the fixed scroll 30. The fixed scroll 30 is fixed to the housing 50.

The refrigerant passage 22 is formed in the fixed scroll 30 and the housing 50 so that it passes through the fixed scroll 30 and the housing 50 (see FIG. 1). The refrigerant after being compressed by the compression mechanism 20 flows through the refrigerant passage 22. The first space S1 above the fixed scroll 30 and the second space S2 below the housing 50 communicate with each other through the refrigerant passage 22.

Figure 2:
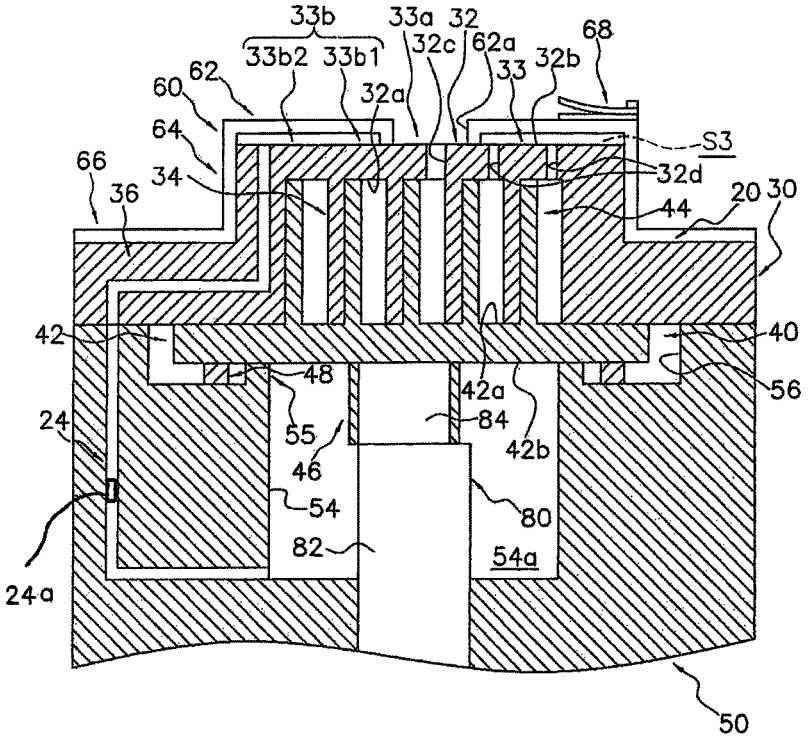
FIG. 2 is a schematic cross-sectional view illustrating the vicinity of a compression mechanism of the scroll compressor illustrated in FIG. 1.

An oil supply path 24 is formed in the fixed scroll 30 and the housing 50 so that it passes through the fixed scroll 30 and the housing 50 (see FIG. 2). The oil supply path 24 is for supplying the oil O to a rear surface adjacent space S3 described later. The crank chamber 54*a* and the rear surface adjacent space S3 communicate with each other through the oil supply path 24. The oil supply path 24 will be described later, along with the description of the cover member 60.

(2-2-1) Fixed Scroll

The fixed scroll 30 includes a flat plate-shaped fixed-side end plate 32, a fixed-side wrap 34 protruding from a front surface 32*a* of the fixed-side end plate 32 (the surface facing the movable scroll 40), and a peripheral edge portion 36 surrounding the fixed-side wrap 34 (see FIG. 1).

The fixed-side end plate 32 is a disk-shaped member.

A discharge port 32*c* passes through the center of the fixed-side end plate 32 in the thickness direction (vertical direction). The discharge port 32*c* communicates with the compression chamber Sc that will be described later. The gas refrigerant compressed in the compression chamber Sc is discharged through the discharge port 32*c*, and flows into the first space S1 on the side of a rear surface 32*b* of the fixed-side end plate 32 (the side opposite to the front surface 32*a* from which the fixed-side wrap 34 protrudes). The refrigerant that has flowed from the compression chamber Sc into the first space S1 passes through the refrigerant passage 22 formed through the fixed scroll 30 and the housing 50 (see FIG. 1), and flows into the second space S2 below the housing 50.

An oil passage 32*d* passes through the fixed-side end plate 32 in the thickness direction (vertical direction). Through the oil passage 32*d*, the compression chamber Sc communicates with the rear surface adjacent space S3 to be described later, which is disposed on the side of the rear surface 32*b* of the fixed-side end plate 32. In particular, through the oil passage 32*d*, the compression chamber Sc having a low or intermediate pressure communicates with the rear surface adjacent space S3 during steady operation. The oil O in the rear surface adjacent space S3 is guided to the compression chamber Sc through the oil passage 32*d*. Although two oil passages 32*d* are illustrated in FIG. 2, the number of oil passages 32*d* is not limited to two. For example, one oil passage, or three or more oil passages may be formed.

The fixed-side wrap 34 is formed in a spiral shape. The compression chamber Sc is formed between the fixed scroll 30 and the movable scroll 40 by the fixed-side wrap 34 being combined with a movable-side wrap 44 of the movable scroll 40 described later such that the front surface 32*a* of the fixed-side end plate 32 and a front surface 42*a* of a movable-side end plate 42 face each other.

The peripheral edge portion 36 is formed in a thick ring shape and disposed to surround the fixed-side wrap 34. The peripheral edge portion 36 functions as a thrust portion that comes in sliding contact with the movable-side end plate 42 of the movable scroll 40.

A communication groove 36*a* is formed in a lower surface of the peripheral edge portion 36 (see FIG. 1). The communication groove 36*a* extends from an inner peripheral edge of the peripheral edge portion 36 toward an outer peripheral side. The communication groove 36*a* is formed to communicate with the compression chamber Sc (during compression) that has an intermediate pressure during steady operation of the scroll compressor 100.

When the scroll compressor 100 is operated and the movable scroll 40 turns, the communication groove 36*a* communicates with a back pressure space S4 (the space facing a rear surface 42*b* of the movable-side end plate 42 on the peripheral side) for a predetermined period during one turning cycle (see FIG. 1), via a communication hole 42*c* (see FIG. 1) formed in the movable-side end plate 42 of the movable scroll 40 described later. The communication groove 36*a* communicates with the compression chamber Sc having an intermediate pressure (during compression). That is, the compression chamber Sc having an intermediate pressure and the back pressure space S4 communicate with each other through the communication groove 36*a* and the communication hole 42*c* for a predetermined period during one turning cycle of the movable scroll 40. With this configuration, the back pressure space S4 has an intermediate pressure during steady operation of the scroll compressor 100.

(2-2-2) Movable Scroll

As illustrated in FIG. 1, the movable scroll 40 mainly includes the flat plate-shaped movable-side end plate 42, the spiral movable-side wrap 44 protruding from the front surface 42*a* of the movable-side end plate 42, and a boss 46 protruding from the rear surface 42*b* of the movable-side end plate 42. The front surface 42*a* (upper surface) of the movable-side end plate 42 faces the fixed scroll 30. The rear surface 42*b* of the movable-side end plate 42 is a surface opposite to the front surface 42*a* and faces an upper surface of the housing 50.

The movable-side end plate 42 is a disk-shaped member. As illustrated in FIG. 1, the communication hole 42*c* passes through the movable-side end plate 42 in the thickness direction (vertical direction). The communication hole 42*c* is formed at such a position that communicates with the communication groove 36*a* formed in the peripheral edge portion 36 of the fixed scroll 30 for a predetermined period during one turning cycle when the movable scroll 40 turns.

The movable-side wrap 44 extends upward from the front surface 42*a* of the movable-side end plate 42. The movable-side wrap 44 is combined with the fixed-side wrap 34 to form the compression chamber Sc.

The boss 46 is formed in a cylindrical shape. The boss 46 extends downward from the rear surface 42*b* of the movable-side end plate 42. An upper portion of the cylindrical boss 46 is closed by the movable-side end plate 42. A bearing metal (not illustrated) is provided in a hollow portion of the boss 46.

The boss 46 is disposed in the crank chamber 54*a* formed by the housing 50. The movable scroll 40 and the crankshaft 80 are coupled by an eccentric portion 84 of the crankshaft 80 described later being inserted into the hollow portion of the boss 46 (see FIG. 2). As described later, the crankshaft 80 is also coupled to the motor 70, and therefore the movable scroll 40 is coupled to the motor 70 via the crankshaft 80. When the motor 70 is operated, the movable scroll 40 turns.

The movable scroll 40, which is turned by the motor 70, revolves with respect to the fixed scroll 30 without rotating, by means of an Oldham's coupling 48 disposed on the rear surface 42*b* of the movable-side end plate 42 (see FIG. 1). When the movable scroll 40 revolves with respect to the fixed scroll 30, the gas refrigerant in the compression chamber Sc of the compression mechanism 20 is compressed. More specifically, when the movable scroll 40 revolves, the gas refrigerant is sucked through the suction pipe 12 into the compression chamber Sc on the peripheral side, and thereafter, the compression chamber Sc moves toward the center of the fixed-side end plate 32 and the movable-side end plate 42. As the compression chamber Sc moves toward the center, the volume of the compression chamber Sc decreases and the pressure in the compression chamber Sc increases. That is, the compression chamber Sc on the central side has a higher pressure than the compression chamber Sc on the peripheral side. The high-pressure gas refrigerant compressed by the compression mechanism 20 passes through the discharge port 32*c*, formed in the fixed-side end plate 32, from the compression chamber Sc on the central side to the first space S1 above the fixed scroll 30 (on the side of the rear surface 32*b* of the fixed-side end plate 32). The first space S1 is an example of a high-pressure space. The high-pressure refrigerant discharged into the first space S1 passes through the refrigerant passage 22 formed through the fixed scroll 30 and the housing 50, and flows into the first space S1 below the housing 50.

Here, the difference in pressure of the compression chamber Sc depending on the position will be further described. Here, the pressure of the compression chamber Sc means the pressure of the compression chamber Sc during steady operation of the scroll compressor 100.

When the compression mechanism 20 is viewed along the axial direction of the crankshaft 80 (i.e., viewed from above), a low-pressure compression chamber Sc, an intermediate-pressure compression chamber Sc, and a high-pressure compression chamber Sc are arranged in that order from the outer peripheral side in the compression chamber Sc. Here, in the low-pressure compression chamber Sc, the pressure does not rise above the suction pressure during steady operation of the scroll compressor 100. In the high-pressure compression chamber Sc, the pressure rises to the discharge pressure during steady operation of the scroll compressor 100. In the intermediate-pressure compression chamber Sc, the maximum value of the pressure is set between the suction pressure and the discharge pressure during steady operation of the scroll compressor 100.

The arrangement of the respective compression chambers Sc having different pressures will be described in further detail.

Here, the outermost compression chamber Sc at the time when suction of the refrigerant is completed is referred to as the low-pressure compression chamber Sc. The low-pressure compression chamber Sc is formed in a range of about one circumference from a winding end point of the fixed-side wrap 34 of the fixed scroll 30 on the inner side of the winding end point.

Here, the innermost compression chamber Sc just before the compressed refrigerant starts to be discharged from the discharge port is referred to as the high-pressure compression chamber Sc. The high-pressure compression chamber Sc is formed in a range of about one circumference from a winding start point of the fixed-side wrap 34 of the fixed scroll 30 on the outer side of the winding start point (see the hatching of dots in the central portion of the fixed scroll 30 in FIG. 3).

Figure 3:
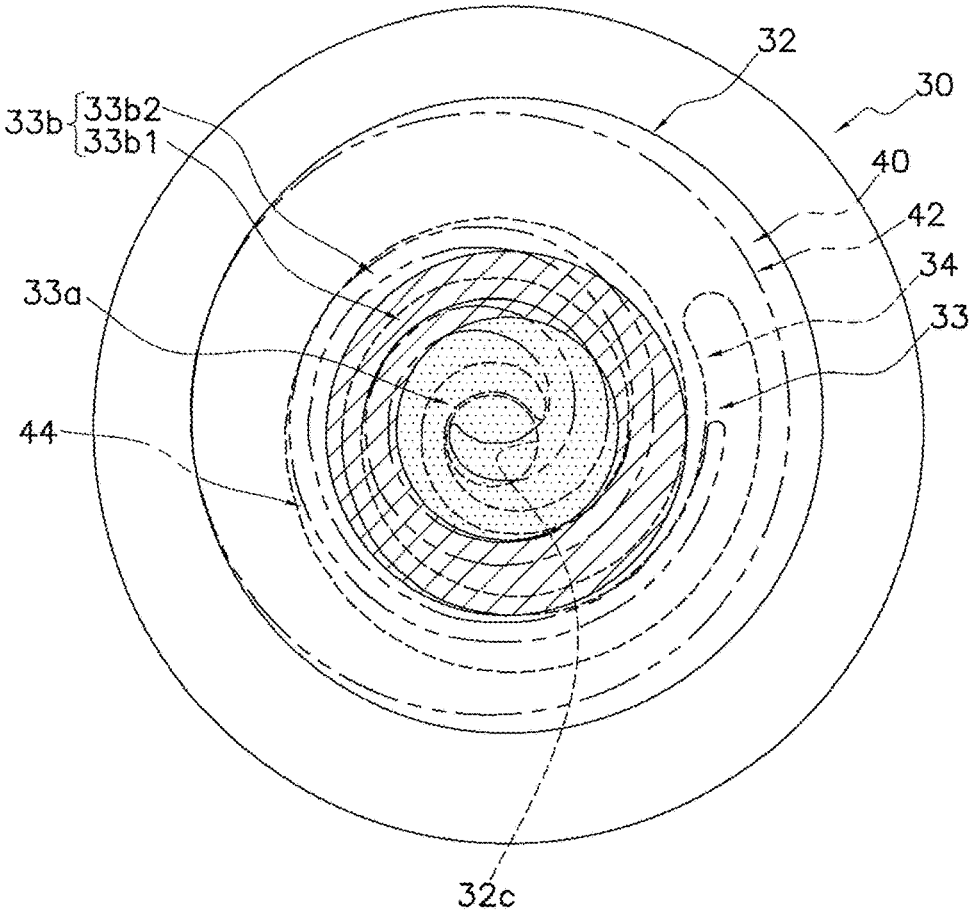
FIG. 3 is an explanatory view of arrangement of a high-pressure adjacent portion, an intermediate-pressure adjacent portion, and a low-pressure adjacent portion included in a compression chamber adjacent portion of a fixed-side end plate of a fixed scroll of the scroll compressor illustrated in FIG. 1.
Figure 4:
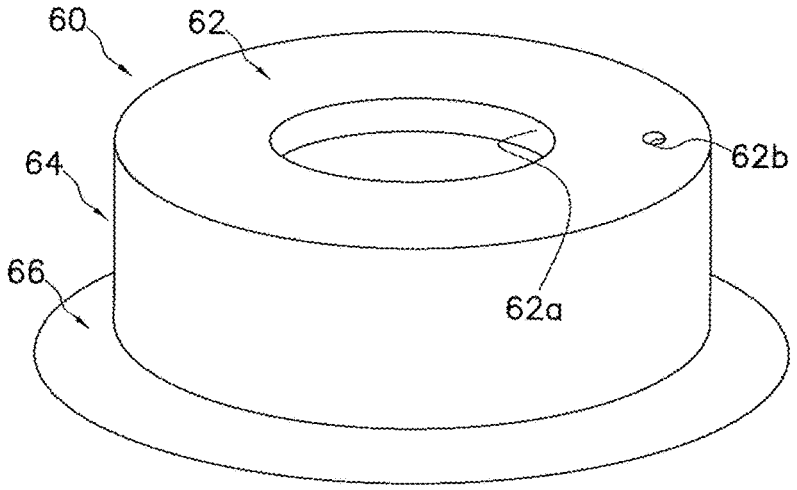
FIG. 4 is a schematic perspective view illustrating a cover member of the scroll compressor illustrated in FIG. 1.

Here, the intermediate-pressure compression chamber Sc is located on the inner side of the low-pressure compression chamber Sc and on the outer side of the high-pressure compression chamber Sc (see the hatching of diagonal lines of the fixed scroll 30 in FIG. 3).

The fixed-side end plate 32 includes a compression chamber adjacent portion 33 at which the front surface 32*a* of the fixed-side end plate 32 faces the compression chamber Sc (see FIG. 2). The compression chamber adjacent portion 33 includes a high-pressure adjacent portion 33*a* disposed at the central portion, and an intermediate- and low-pressure adjacent portion 33*b*. At the high-pressure adjacent portion 33*a*, the front surface 32*a* of the fixed-side end plate 32 faces the high-pressure compression chamber Sc. The intermediate- and low-pressure adjacent portion 33*b* is disposed on the outer side of the high-pressure adjacent portion 33*a* (see FIGS. 2 and 3). The intermediate- and low-pressure adjacent portion 33*b* includes a low-pressure adjacent portion 33*b*2 at which the front surface 32*a* of the fixed-side end plate 32 faces the low-pressure compression chamber Sc, and an intermediate-pressure adjacent portion 33*b*1 at which the front surface 32*a* of the fixed-side end plate 32 faces the intermediate-pressure compression chamber Sc (see FIGS. 2 and 3).

(2-2-3) Housing

The housing 50 is a member pressed into and fixed to the cylindrical member of the casing 10. The outer periphery of the housing 50 is in close contact with the inner surface of the cylindrical member of the casing 10.

The fixed scroll 30 is fixed to the housing 50 in such a manner that the lower surface of the peripheral edge portion 36 of the fixed scroll 30 and the upper surface of the housing 50 face each other. The fixed scroll 30 is fixed to the housing 50 by a fixing member (e.g. a bolt) not illustrated. The housing 50 supports the movable scroll 40 from below via the Oldham's coupling 48 disposed above the housing 50.

As illustrated in FIG. 1, the housing 50 includes a first recess 54, a second recess 56, and an upper bearing 52. The first recess 54 is disposed while being recessed at an upper central portion of the housing 50. The second recess 56 is disposed to surround the first recess 54. The upper bearing 52 is disposed below the first recess 54 (see FIGS. 1 and 2). A part of the oil supply path 24 is formed in the housing 50 (see FIG. 2).

The first recess 54 constitutes a side surface of the crank chamber 54*a* in which the boss 46 of the movable scroll 40 is disposed.

The second recess 56 forms parts of a lower surface and a side surface that surround the back pressure space S4. The first recess 54 and the second recess 56 are separated from each other by an annular wall 55 disposed at the boundary between the first recess 54 and the second recess 56 (see FIG. 2).

The back pressure space S4 is formed in an upper part of the second recess 56. The back pressure space S4 is disposed around the crank chamber 54*a* formed by the first recess 54. A seal ring (not illustrated) is disposed on the upper end of the wall 55 facing the rear surface 42*b* of the movable-side end plate 42. The back pressure space S4 and the crank chamber 54*a* are separated from each other by the seal ring.

During steady operation of the scroll compressor 100, the high-pressure oil O flows from the oil storage space 16 into the crank chamber 54*a* as described later. Therefore, the crank chamber 54*a* has a high pressure during steady operation of the scroll compressor 100. The pressure in the crank chamber 54*a* generates a force that pushes the movable scroll 40 toward the fixed scroll 30, on the rear surface 42*b* of the movable-side end plate 42 facing the crank chamber 54*a* (that is, the rear surface 42*b* at the central portion).

As described above, the back pressure space S4 communicates with the compression chamber Sc that is undergoing compression when the scroll compressor 100 is in operation. During steady operation of the scroll compressor 100, the back pressure space S4 has an intermediate pressure. The pressure in the back pressure space S4 generates a force that pushes the movable scroll 40 toward the fixed scroll 30, on the rear surface 32*b* of the movable-side end plate 42 facing the back pressure space S4 (that is, the rear surface 32*b* at the peripheral edge portion).

As describe above, when the scroll compressor 100 is in operation, the movable scroll 40 is pushed toward the fixed scroll 30 by the force generated by the pressure in the crank chamber 54*a* and the force generated by the pressure in the back pressure space S4.

The upper bearing 52 is provided with a bearing metal (not illustrated). The upper bearing 52 rotatably supports a main shaft 82 of the crankshaft 80. An upper bearing oil passage (not illustrated) is formed outside the bearing metal disposed in the upper bearing 52. A part of the oil O that has been supplied from an oil passage 86 formed in the crankshaft 80 described later and lubricated the bearing metal and the crankshaft 80 flows into the crank chamber 54*a* through the upper bearing oil passage.

(2-3) Cover Member

The cover member 60 is disposed in the first space S1 on the side of the rear surface 32*b* of the fixed-side end plate 32 of the fixed scroll 30.

The cover member 60 is attached to the fixed scroll 30 by a fixing means (e.g. a bolt) not illustrated. Note that the bolt is an exemplary method of fixing the cover member 60 to the fixed scroll 30, and such method can be appropriately selected. For example, the cover member 60 may be fixed to the fixed scroll 30 by welding. The cover member 60 is attached to the fixed scroll 30 such that the rear surface adjacent space S3 formed between the cover member 60 and the fixed-side end plate 32 is kept airtight from the first space S1; in other words, such that the rear surface adjacent space S3 does not have the same high pressure as the first space S1. For example, a seal material such as a gasket may be disposed at an appropriate position between the cover member 60 and the fixed scroll 30 in order to maintain the airtightness.

Figure 5:
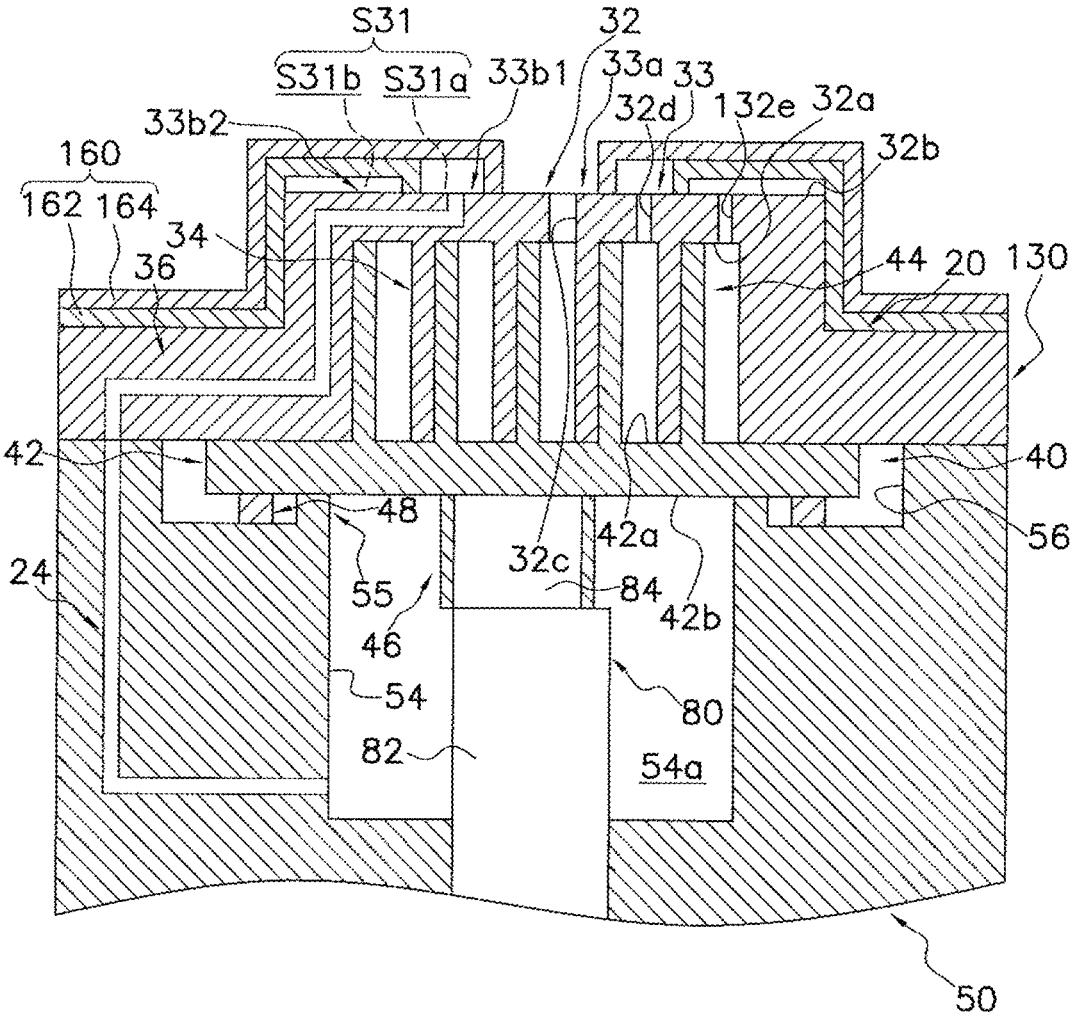
FIG. 5 is a schematic cross-sectional view illustrating the vicinity of a compression mechanism of a scroll compressor of Modification A.

The shape of the cover member 60 is not limited. For example, the cover member 60 has a shape as illustrated in FIG. 5. The cover member 60 mainly includes an annular portion 62, a cylindrical portion 64, and a flange 66. The annular portion 62 is a disk-shaped portion with a circular hole 62*a* formed at the central portion. The cylindrical portion 64 extends downward from the outer edge of the annular portion 62. The flange 66 extends outward in the radial direction from the lower end of the cylindrical portion 64 (toward the outer peripheral side of the fixed scroll 30). The cover member 60 is fixed to the fixed scroll 30 by the fixing means (not illustrated) at, for example, the annular portion 62 and the flange 66. The cover member 60 defines the rear surface adjacent space S3 between the lower surface of the annular portion 62 and the rear surface 32*b* of the fixed-side end plate 32 (see FIG. 2). The rear surface adjacent space S3 formed between the lower surface of the annular portion 62 and the rear surface 32*b* of the fixed-side end plate 32 is an annular space. The volume of the rear surface adjacent space S3 is smaller than the volume of the first space S1 in which the cover member 60 is disposed.

Here, the rear surface adjacent space S3 is an intermediate-pressure space to which the oil O having an intermediate pressure is supplied during steady operation through the oil supply path 24 formed in the housing 50 and the fixed scroll 30. The rear surface adjacent space S3 faces at least a part of the rear surface 32*b* of the intermediate- and low-pressure adjacent portion 33*b* in the compression chamber adjacent portion 33 of the fixed-side end plate 32. In particular, the rear surface adjacent space S3 preferably faces at least the rear surface 32*b* of the low-pressure adjacent portion 33*b*2 in the compression chamber adjacent portion 33 of the fixed-side end plate 32 (see FIG. 2). The rear surface adjacent space S3 further preferably faces the rear surface 32*b* of the intermediate-pressure adjacent portion 33*b*1 in the compression chamber adjacent portion 33 of the fixed-side end plate 32 (see FIG. 2).

Alternatively, the rear surface adjacent space S3 may faces a part of the rear surface 32*b* of the high-pressure adjacent portion 33*a* in the compression chamber adjacent portion 33 of the fixed-side end plate 32. However, the rear surface adjacent space S3 preferably does not face the rear surface 32*b* of the high-pressure adjacent portion 33*a* in the compression chamber adjacent portion 33 of the fixed-side end plate 32. In other words, the annular portion 62 of the cover member 60 is provided with the circular hole 62*a* preferably at a portion corresponding to the position of the high-pressure adjacent portion 33*a* in the compression chamber adjacent portion 33 of the fixed-side end plate 32. This is because an equal pressure is preferably applied to both the front surface 32*a* and the rear surface 32*b* of the high-pressure adjacent portion 33*a* in the compression chamber adjacent portion 33 of the fixed-side end plate 32.

The conventional structure is assumed here in which the scroll compressor 100 does not include the cover member 60 and the rear surface adjacent space S3 is not formed. In this case, a low pressure is acting on the front surface 32*a* of the low-pressure adjacent portion 33*b*2 in the compression chamber adjacent portion 33 of the fixed-side end plate 32. Meanwhile, the rear surface 32*b* of the low-pressure adjacent portion 33*b*2 in the compression chamber adjacent portion 33 of the fixed-side end plate 32 faces the first space S1, and therefore a high pressure is acting on the rear surface 32*b* of the low-pressure adjacent portion 33*b*2 of the fixed-side end plate 32. In this case, an intermediate pressure is acting on the front surface 32*a* of the intermediate-pressure adjacent portion 33*b*1 in the compression chamber adjacent portion 33 of the fixed-side end plate 32. Meanwhile, the rear surface 32*b* of the intermediate-pressure adjacent portion 33*b*1 in the compression chamber adjacent portion 33 of the fixed-side end plate 32 faces the first space S1, and therefore a high pressure is acting on the rear surface 32*b* of the intermediate-pressure adjacent portion 33*b*1 of the fixed-side end plate 32. With such a pressure relationship, the low-pressure adjacent portion 33*b*2 and the intermediate-pressure adjacent portion 33*b*1 in the compression chamber adjacent portion 33 of the fixed-side end plate 32 tend to be deformed. As a result, a gap (tip gap) between the tip of the movable-side wrap 44 and the front surface 32*a* of the fixed-side end plate 32 or a gap (tip gap) between the tip of the fixed-side wrap 34 and the front surface 42*a* of the movable-side end plate 42 tends to widen, and thus the efficiency of the scroll compressor 100 tends to decrease.

The high-pressure refrigerant has a high temperature. Therefore, in a case where the entire rear surface 32*b* of the compression chamber adjacent portion 33 of the fixed-side end plate 32 is adjacent to the first space S1, the heat may be transferred to the refrigerant in the low- or intermediate-pressure compression chamber Sc and the compressed gas may be overheated. Due to such heat transfer from the first space S1, the gap between the tip of the fixed-side wrap 34 and the movable-side end plate 42 facing the tip of the fixed-side wrap 34, or the gap between the tip of the movable-side wrap 44 and the fixed-side end plate 32 facing the tip of the movable-side wrap 44 may be non-uniform.

Meanwhile, in a case where the cover member 60 is provided and the intermediate-pressure rear surface adjacent space S3 is formed to face at least a part of the rear surface 32*b* of the low-pressure adjacent portion 33*b*2 (preferably the entire rear surface 32*b* of the low-pressure adjacent portion 33*b*2) in the compression chamber adjacent portion 33 of the fixed-side end plate 32, the pressure difference between the side of the front surface 32*a* and the side of the rear surface 32*b* of the low-pressure adjacent portion 33*b*2 becomes relatively small, and the deformation of the fixed scroll 30 is easily reduced. Furthermore, in a case where the intermediate-pressure rear surface adjacent space S3 is formed to face at least a part of the rear surface 32*b* of the intermediate-pressure adjacent portion 33*b*1 (preferably the entire rear surface 32*b* of the intermediate-pressure adjacent portion 33*b*1) in the compression chamber adjacent portion 33 of the fixed-side end plate 32, the pressure difference between the side of the front surface 32*a* and the side of the rear surface 32*b* of the intermediate-pressure adjacent portion 33*b*1 is easily cancelled, and thus the deformation of the fixed scroll 30 is more easily reduced.

The heat in the first space S1 is less likely to be transferred to the refrigerant in the low- or intermediate-pressure compression chamber Sc because of the rear surface adjacent space S3, and therefore overheating of the compressed gas is easily reduced. The heat in the first space S1 is less likely to be transferred to the refrigerant in the low- or intermediate-pressure compression chamber Sc because of the rear surface adjacent space S3. This makes it easy to reduce the decrease in efficiency of the scroll compressor caused by, for example, the non-uniform tip gap associated with the heat transfer from the first space S1 to the low- or intermediate-pressure compression chamber Sc.

The oil O having an intermediate pressure is supplied to the rear surface adjacent space S3 through the oil supply path 24 formed in the fixed scroll 30 and the housing 50. The oil O supplied to various sliding contact portions of the scroll compressor 100 through the oil passage 86 formed inside the crankshaft 80 flows into the crank chamber 54*a* formed by the housing 50. For example, the oil O supplied to the sliding contact portion between the eccentric portion 84 of the crankshaft 80 and the boss 46 of the movable scroll 40, and the oil O supplied to the sliding contact portion between the main shaft 82 of the crankshaft 80 and the upper bearing 52 flow into the crank chamber 54*a*. Such oil O present in the crank chamber 54*a* is guided to the rear surface adjacent space S3 through the oil supply path 24. A flow rate regulating member 24*a* is preferably disposed in the oil supply path 24. The flow rate regulating member 24*a* narrows the flow path area of the oil supply path 24 in order to reduce the pressure of the oil O supplied to the rear surface adjacent space S3 to a suitable pressure. Flow rate regulating members are well known. Examples of known flow rate regulating members include an orifice of reduced diameter or a valve.

Here, the oil O in the crank chamber 54*a* is guided to the rear surface adjacent space S3 through the oil supply path 24 formed in the fixed scroll 30 and the housing 50, but the supply of the oil is not limited to this example. Alternatively, the oil O in another space may be guided to the rear surface adjacent space S3 through another path.

A communication hole 62*b* through which the first space S1 communicates with the rear surface adjacent space S3 is formed in the annular portion 62. A relief valve 68 is attached to the cover member 60 to close the communication hole 62*b*. The relief valve 68 is configured to open when the pressure in the rear surface adjacent space S3 rises above a predetermined pressure (for example, when the pressure in the rear surface adjacent space S3 becomes greater than the pressure in the first space S1 by a predetermined value or more).

The rear surface adjacent space S3 has an intermediate pressure during steady operation of the scroll compressor 100. Depending on the operating condition, however, the pressure in the rear surface adjacent space S3 may rise abnormally, for example, at the time of transition of the scroll compressor 100 to steady operation. To address this problem, the communication hole 62*b* is formed in the cover member 60 and the relief valve 68 is further provided at the position corresponding to the communication hole 62*b*. With this configuration, even if the pressure in the rear surface adjacent space S3 rises abnormally, the pressure can be released to the first space S1 and the reliability of the scroll compressor 100 can be secured.

(2-4) Motor

The motor 70 includes an annular stator 72 fixed to the inner wall surface of the cylindrical member of the casing 10, and a rotor 74 disposed on the inner side of the stator 72 (see FIG. 1).

The rotor 74 is rotatably accommodated on the inner side of the stator 72 with a small gap (air gap passage) from the stator 72. The rotor 74 is coupled to the movable scroll 40 via the crankshaft 80. Specifically, the rotor 74 is coupled to the boss 46 of the movable scroll 40 via the crankshaft 80 (see FIG. 1). The motor 70 turns the movable scroll 40 by rotating the rotor 74.

(2-5) Crankshaft

The crankshaft 80 couples the rotor 74 of the motor 70 and the movable scroll 40 of the compression mechanism 20, and transmits the driving force of the motor 70 to the movable scroll 40.

The crankshaft 80 is disposed inside the casing 10 while extending in the vertical direction along the axial direction of the cylindrical member of the casing 10 (see FIG. 1).

The crankshaft 80 includes the main shaft 82 with a center axis matching the axis of the cylindrical member of the casing 10, and the eccentric portion 84 that is eccentrically disposed relative to the main shaft 82 (see FIG. 1).

The main shaft 82 is rotatably supported by the upper bearing 52 of the housing 50 and the lower bearing 90 (see FIG. 1). The main shaft 82 is coupled to the rotor 74 of the motor 70 between the upper bearing 52 and the lower bearing 90 (see FIG. 1).

The eccentric portion 84 is inserted into the boss 46 of the movable scroll 40. The crankshaft 80 is coupled to the movable scroll 40 at the eccentric portion 84.

The oil passage 86 is formed inside the crankshaft 80 (see FIG. 1). The oil O for lubrication is supplied to various sliding contact portions through the oil passage 86. A positive displacement oil supply pump (not illustrated) is provided at a lower end opening of the oil passage 86 (see FIG. 1). The oil supply pump sucks up the high-pressure oil O from the oil storage space 16 and supplies the oil O to the oil passage 86.

The oil passage 86 extends inside the crankshaft 80 vertically from the lower end to the upper end of the crankshaft 80. The oil passage 86 opens at the upper and lower ends of the crankshaft 80. The oil passage 86 includes branched passages that extend horizontally from a main passage extending vertically. The oil O is supplied through the branched passages to the bearing metal disposed in the upper bearing 52 and a bearing metal disposed in the lower bearing 90.

The oil O flowing out of the upper end opening of the oil passage 86 lubricates a sliding contact portion between the eccentric portion 84 of the crankshaft 80 and the bearing metal disposed on the boss 46 of the movable scroll 40, and then flows into the crank chamber 54*a*. The oil O flows through the branched passage of the oil passage 86 and lubricates the sliding contact portion between the main shaft 82 and the bearing metal disposed in the upper bearing 52, and then flows into the crank chamber 54*a* through an upper bearing oil passage (not illustrated) formed in the housing 50 or from an upper end of the bearing metal disposed in the upper bearing 52.

(2-6) Lower Bearing

The lower bearing 90 is disposed below the motor 70. The lower bearing 90 is fixed to the cylindrical member of the casing 10. The bearing metal (not illustrated) is disposed in the lower bearing 90. The lower bearing 90 rotatably supports the main shaft 82 of the crankshaft 80.

(3) Operation of Scroll Compressor

The operation of the scroll compressor 100 will be described.

(3-1) Compressing Operation

The compressing operation of the scroll compressor 100 will be described.

When the motor 70 is driven, the rotor 74 rotates and the crankshaft 80 coupled to the rotor 74 rotates. When the crankshaft 80 rotates, the movable scroll 40 coupled to the crankshaft 80 turns. The movable scroll 40 revolves with respect to the fixed scroll 30 without rotating, by means of the Oldham's coupling 48. When the movable scroll 40 turns, low-pressure gas refrigerant (at suction pressure) is sucked into the casing 10 through the suction pipe 12. More specifically, the low-pressure gas refrigerant is sucked from the suction pipe 12 into the compression chamber Sc on the peripheral side. As the movable scroll 40 turns, the suction pipe 12 stops communicating with the compression chamber Sc, and the pressure of the compression chamber Sc rises in accordance with a decrease in the volume of the compression chamber Sc. The pressure of the gas refrigerant rises as the gas refrigerant moves from the compression chamber Sc on the peripheral side to the compression chamber Sc on the central side, and finally reaches a high pressure (discharge pressure). The high-pressure gas refrigerant after being compressed by the compression mechanism 20 is discharged from the discharge port 32*c* located near the center of the fixed-side end plate 32. The high-pressure gas refrigerant discharged from the discharge port 32*c* flows into the first space S1. The gas refrigerant in the first space S1 passes through the refrigerant passage 22 formed through the fixed scroll 30 and the housing 50, flows into the second space S2 below the housing 50, and is finally discharged to the outside of the casing 10 through the discharge pipe 14.

(3-2) Oil Supplying Operation

When the crankshaft 80 rotates, the oil O in the oil storage space 16 is sucked up by the oil supply pump (not illustrated) provided at the lower end of the crankshaft 80, flows upward through the oil passage 86 to the upper end opening of the crankshaft 80, and flows out of the upper end opening. A part of the oil O flowing through the oil passage 86 flows out of the branched oil passage that opens to face the inner surface of the bearing metal provided in the upper bearing 52. The oil O flowing out of the upper end opening of the oil passage 86 lubricates the sliding contact portion between the eccentric portion 84 and the boss 46, and then flows into the crank chamber 54*a*. A part of the oil O is stored in the crank chamber 54*a*. The oil O that has flowed through the branched oil passage of the oil passage 86 lubricates the sliding contact portion between the main shaft 82 and the bearing metal disposed in the upper bearing 52, and then flows into the crank chamber 54*a*. A part of the oil O is stored in the crank chamber 54*a*.

The oil O in the crank chamber 54*a* is supplied to the rear surface adjacent space S3 through the oil supply path 24 due to a differential pressure between the crank chamber 54*a* and the rear surface adjacent space S3. The high-pressure oil O is decompressed to a predetermined pressure by the flow rate regulating member 24*a* disposed in the oil supply path 24, and the resultant intermediate-pressure oil O flows into the rear surface adjacent space S3. As a result, the rear surface adjacent space S3 has an intermediate pressure. The oil O that has flowed into the rear surface adjacent space S3 then flows into the compression chamber Sc through the oil passage 32*d* formed in the fixed-side end plate 32, and is used to lubricate the compression mechanism 20.

(4) Characteristics (4-1)

The scroll compressor 100 according to the above embodiment includes the fixed scroll 30, the movable scroll 40, and the cover member 60. The fixed scroll 30 includes the flat plate-shaped fixed-side end plate 32 and the spiral fixed-side wrap 34 protruding from the front surface 32*a* of the fixed-side end plate 32. The movable scroll 40 includes the flat plate-shaped movable-side end plate 42 and the spiral movable-side wrap 44 that protrudes from the front surface 42*a* of the movable-side end plate 42 and is combined with the fixed-side wrap 34 to form the compression chamber Sc. The cover member 60 is disposed in the first space S1 on the side of the rear surface 32*b* of the fixed-side end plate 32, and is attached to the fixed scroll 30. The first space S1 is an example of a high-pressure space. The fixed-side end plate 32 includes the compression chamber adjacent portion 33 at which the front surface 32*a* of the fixed-side end plate 32 faces the compression chamber Sc. The compression chamber adjacent portion 33 includes the high-pressure adjacent portion 33*a* and the intermediate- and low-pressure adjacent portion 33*b*. The high-pressure adjacent portion 33*a* is disposed at the central portion of the compression chamber adjacent portion 33. At the high-pressure adjacent portion 33*a*, the front surface of the fixed-side end plate 32 faces the high-pressure compression chamber Sc. The intermediate- and low-pressure adjacent portion 33*b* is disposed on the outer side of the high-pressure adjacent portion 33*a*. The cover member 60 defines the intermediate-pressure rear surface adjacent space S3 that faces at least a part of the rear surface 32*b* of the intermediate- and low-pressure adjacent portion 33*b* in the compression chamber adjacent portion 33 of the fixed-side end plate 32.

In the scroll compressor 100, the cover member 60 defines the low- or intermediate-pressure rear surface adjacent space S3 that faces at least a part of the rear surface 32*b* of the intermediate- and low-pressure adjacent portion 33*b* (i.e., the portion of the compression chamber adjacent portion 33 that faces the low- or intermediate-pressure compression chamber Sc), among the rear surface 32*b* of the compression chamber adjacent portion 33 of the fixed-side end plate 32 with the front surface 32*a* facing the compression chamber Sc. With such a configuration, the pressure difference between the side of the front surface 32*a* and the side of the rear surface 32*b* of the fixed-side end plate 32 during operation of the scroll compressor 100 is reduced. Therefore, the deformation of the fixed scroll 30 is reduced and the efficient scroll compressor 100 is implemented.

The low- or intermediate-pressure rear surface adjacent space S3 is provided between the first space S1 and the fixed-side end plate 32. This makes it possible to reduce occurrence of the problems such as heating of compressed gas and a decrease in efficiency, caused by the heat transfer from the first space S1 to the low- or intermediate-pressure compression chamber Sc.

(4-2)

In the scroll compressor 100 of the above embodiment, the intermediate- and low-pressure adjacent portion 33*b* includes the low-pressure adjacent portion 33*b*2 at which the front surface 32*a* of the fixed-side end plate 32 faces the low-pressure compression chamber Sc. The rear surface adjacent space S3 faces at least the rear surface of the low-pressure adjacent portion 33*b*2.

During steady operation of the scroll compressor 100, there is no portion in the fixed-side end plate 32 where the side of the front surface 32*a* has a low pressure and the side of the rear surface 32*b* has a high pressure. Therefore, a relatively large deformation of the fixed scroll 30 can be prevented. As a result, the efficient scroll compressor 100 is implemented.

(4-3)

In the scroll compressor 100 of the above embodiment, the volume of the rear surface adjacent space S3 is smaller than the volume of the first space S1.

This scroll compressor 100 is a highly efficient and compact scroll compressor 100 capable of suppressing the deformation of the fixed scroll 30.

(4-4)

In the scroll compressor 100 of the above embodiment, the cover member 60 forms the annular rear surface adjacent space S3.

In the scroll compressor 100, the pressure difference between the side of the front surface 32*a* and the side of the rear surface 32*b* of the fixed-side end plate 32 during steady operation of the scroll compressor 100 can be reduced over the entire circumference. Therefore, a local deformation of the fixed scroll 30 can be reduced.

(4-5)

The scroll compressor 100 of the above embodiment includes the oil supply path 24 through which the intermediate-pressure oil O is supplied to the rear surface adjacent space S3. The oil passage 32*d* is formed in the fixed-side end plate 32. The oil in the rear surface adjacent space S3 is guided to the compression chamber Sc through the oil passage 32*d*.

In the scroll compressor 100, at least a part of the rear surface adjacent space S3 is filled with the intermediate-pressure oil O. Even when the operating condition changes, therefore, a sudden pressure change in the rear surface adjacent space S3 can be reduced as compared to a case where the rear surface adjacent space S3 only contains gas. Since the oil O in the rear surface adjacent space S3 is supplied to the compression chamber Sc, the compression mechanism 20 can reliably be lubricated, and the reliability and performance of the scroll compressor 100 can be improved.

(4-6)

The scroll compressor 100 of the above embodiment includes the relief valve 68. The relief valve 68 is attached to the cover member 60 to close the communication hole 62*b* formed in the cover member 60. The first space S1 communicates with the rear surface adjacent space S3 through the communication hole 62*b*. The relief valve 68 opens when the pressure in the rear surface adjacent space S3 rises above a predetermined pressure.

In the scroll compressor 100, even if the pressure in the rear surface adjacent space S3 rises abnormally for some reason, the pressure can be released to the first space S1 and the reliability of the scroll compressor 100 can be secured.

(5) Modifications

Modifications of the above embodiment will be described below. Note that a part or all of the configurations of each modification may be combined with a part or all of the configurations of another modification as long as the modifications do not contradict each other.

(5-1) Modification A

In the above embodiment, the intermediate-pressure rear surface adjacent space S3 defined by the cover member 60 faces at least a part of the intermediate- and low-pressure adjacent portion 33*b* in the compression chamber adjacent portion 33 of the fixed-side end plate 32, but the present invention is not limited to this configuration.

For example, the fixed scroll and the cover member of the scroll compressor may be formed as illustrated in FIG. 5. Here, only the difference from the above embodiment will be described, and the description of the common configurations will be omitted. In FIG. 5, the configurations similar to those of the above embodiment are denoted with the same reference signs as in the above embodiment.

First, in Modification A, a cover member 160 defines a rear surface adjacent space S31 including a first cover member 162 and a second cover member 164. The first cover member 162 and the second cover member 164 each have a shape similar to that of the cover member 60 of the above embodiment illustrated in FIG. 3. As illustrated in FIG. 5, the second cover member 164 is disposed to cover the first cover member 162.

The rear surface adjacent space S31 includes a first rear surface adjacent space S31*a* and a second rear surface adjacent space S31*b*. The second cover member 164 defines the first rear surface adjacent space S31*a*. The first cover member 162 defines the second rear surface adjacent space S31*b* inside the first rear surface adjacent space S31*a*. Specifically, the second rear surface adjacent space S31*b* is disposed on the outer side of the first rear surface adjacent space S31*a* with reference to the central portion of the compression chamber adjacent portion 33 (the portion where a high-pressure adjacent portion 33*a* is disposed). The first cover member 162 and the second cover member 164 are attached to a fixed scroll 130 in such a state that the first rear surface adjacent space S31*a*, the second rear surface adjacent space S31*b*, and the first space S1 are kept airtight from one another. For example, a seal material such as a gasket may be disposed at an appropriate position in order to maintain the airtightness.

Intermediate-pressure oil O is supplied to the first rear surface adjacent space S31*a* through an oil supply path 24, as in the above embodiment.

Meanwhile, the second rear surface adjacent space S31*b* is mainly filled with low-pressure gas refrigerant. The supply of the low-pressure gas refrigerant to the second rear surface adjacent space S31*b* will be described. A through hole 132*e* that passes through the fixed-side end plate 32 in the vertical direction is formed in a low-pressure adjacent portion 33*b*2 in the compression chamber adjacent portion 33 of the fixed-side end plate 32 of the fixed scroll 130 (see FIG. 5). During one turning cycle of the movable scroll 40, the compression chamber Sc communicates with the second rear surface adjacent space S31*b* for at least a predetermined period through the through hole 132*e*.

With this configuration, during steady operation of the scroll compressor 100, the first space S1 has a high pressure, the first rear surface adjacent space S31*a* has an intermediate pressure, and the second rear surface adjacent space S31*b* has a low pressure.

Here, the low-pressure compression chamber Sc communicates with the second rear surface adjacent space S31*b* and mainly the gas refrigerant is introduced into the second rear surface adjacent space S31*b*, whereby the second rear surface adjacent space S31*b* has a low pressure. However, the present invention is not limited to this configuration. For example, the low-pressure oil O may be supplied to the second rear surface adjacent space S31*b* in a similar manner to the case where the intermediate-pressure oil O is supplied to the first rear surface adjacent space S31*a* through the oil supply path 24. The second rear surface adjacent space S31*b* is also filled with the oil O; therefore, even when the operating condition changes, a sudden pressure change in the rear surface adjacent space S3 can be reduced as compared to a case where the second rear surface adjacent space S31*b* only contains gas.

Although the intermediate-pressure oil O is preferably supplied to the first rear surface adjacent space S31*a*, the present invention is not limited to this example. For example, intermediate-pressure gas refrigerant may be supplied to the first rear surface adjacent space S31*a* with a configuration in which the first rear surface adjacent space S31*a* communicates with the intermediate-pressure compression chamber Sc through a through hole, in a similar manner to the case where the second rear surface adjacent space S31*b* communicates with the low-pressure compression chamber Sc through the through hole 132*e*. The same applies to the above embodiment.

The rear surface adjacent space S31 (the first rear surface adjacent space S31*a* and the second rear surface adjacent space S31*b*) faces at least a part of a rear surface 32*b* of an intermediate- and low-pressure adjacent portion 33*b* in the compression chamber adjacent portion 33 of the fixed-side end plate 32. In particular, the first rear surface adjacent space S31*a* preferably faces at least the rear surface 32*b* of an intermediate-pressure adjacent portion 33*b*1 in the compression chamber adjacent portion 33 of the fixed-side end plate 32 (see FIG. 5). The second rear surface adjacent space S31*b* preferably faces at least the rear surface 32*b* of the low-pressure adjacent portion 33*b*2 in the compression chamber adjacent portion 33 of the fixed-side end plate 32 (see FIG. 5). The low-pressure second rear surface adjacent space S31*b* is preferably disposed on the outer side of the intermediate-pressure adjacent portion 33*b*1 in the compression chamber adjacent portion 33 of the fixed-side end plate 32 with reference to the central portion of the compression chamber adjacent portion 33 (the portion where the high-pressure adjacent portion 33*a* is disposed).

In the scroll compressor, the intermediate- and low-pressure adjacent portion 33*b* includes the intermediate-pressure adjacent portion 33*b*1 at which the front surface 32*a* of the fixed-side end plate 32 faces the intermediate-pressure compression chamber Sc. The rear surface adjacent space S31 includes at least the low-pressure first rear surface adjacent space S31*a*. The first rear surface adjacent space S31*a* is an example of a low-pressure rear surface adjacent space. The first rear surface adjacent space S31*a* is disposed on the outer side of the intermediate-pressure adjacent portion 33*b*1 with reference to the central portion of the compression chamber adjacent portion 33. During steady operation of the scroll compressor, therefore, there is no portion in the fixed-side end plate 32 where the side of the front surface 32*a* has an intermediate pressure and the side of the rear surface 32*b* has a low pressure. Therefore, deformation of the fixed scroll 130 can be prevented. As a result, the efficient scroll compressor is implemented.

In the scroll compressor, the rear surface adjacent space S31 includes the intermediate-pressure first rear surface adjacent space S31*a* and the low-pressure second rear surface adjacent space S31*b*. The second rear surface adjacent space S31*b* is disposed on the outer side of the first rear surface adjacent space S31*a* with reference to the central portion of the compression chamber adjacent portion 33. As a common characteristic of a scroll compressor, a high-pressure compression chamber is disposed on the central side of the scroll, a low-pressure compression chamber is disposed on the outer side of the scroll, and an intermediate-pressure compression chamber is disposed between the high-pressure compression chamber and the low-pressure compression chamber. In the scroll compressor, the intermediate-pressure first rear surface adjacent space S31*a* is disposed on the inner side and the low-pressure second rear surface adjacent space S31*b* is disposed on the outer side with reference to the central portion of the compression chamber adjacent portion 33 in accordance with the above pressure distribution. During steady operation of the scroll compressor, therefore, the pressure difference between the side of the front surface 32*a* and the side of the rear surface 32*b* of the fixed-side end plate 32 is less likely to occur. As a result, the deformation of the fixed scroll 130 is reduced and a highly efficient scroll compressor is implemented.

In the scroll compressor, the intermediate- and low-pressure adjacent portion 33*b* includes the low-pressure adjacent portion 33*b*2 at which the front surface 32*a* of the fixed-side end plate 32 faces the low-pressure compression chamber Sc, and the intermediate-pressure adjacent portion 33*b*1 at which the front surface 32*a* of the fixed-side end plate 32 faces the intermediate-pressure compression chamber Sc. The first rear surface adjacent space S31*a* faces the rear surface of the intermediate-pressure adjacent portion 33*b*1. The second rear surface adjacent space S31*b* faces the rear surface of the low-pressure adjacent portion 33*b*2. In the scroll compressor, the pressure on the side of the front surface 32*a* and the pressure on the side of the rear surface 32*b* are substantially equal throughout the compression chamber adjacent portion 33 of the fixed-side end plate 32. Therefore, the deformation of the fixed scroll 130 is particularly easily reduced and the efficient scroll compressor is implemented.

(5-2) Modification B

In Modification A, the intermediate-pressure first rear surface adjacent space S31*a* and the low-pressure second rear surface adjacent space S31*b* are defined using the two cover members 162 and 164, but the modification is not limited to this configuration.

Figure 6:
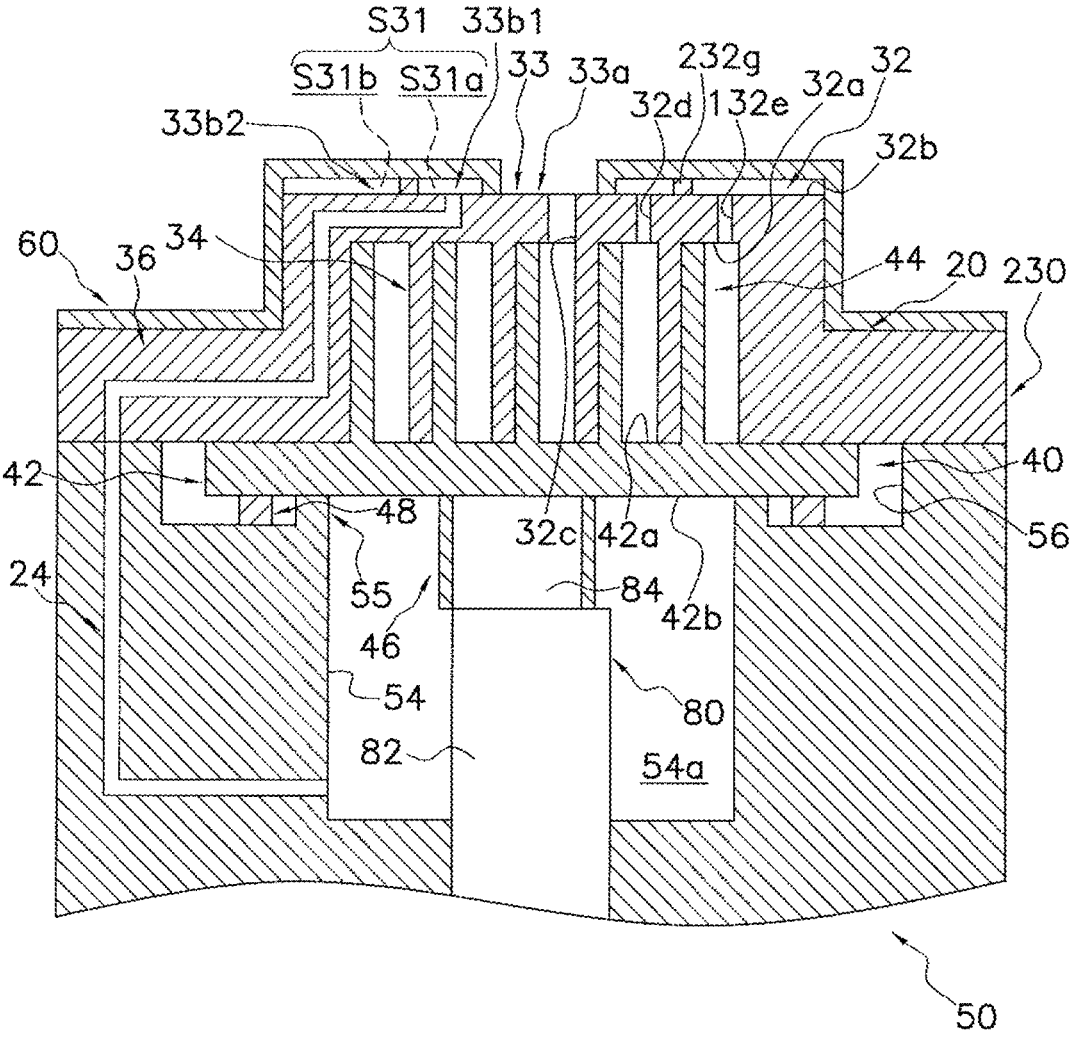
FIG. 6 is a schematic cross-sectional view illustrating the vicinity of a compression mechanism of a scroll compressor of Modification B.

As illustrated in FIG. 6, for example, a fixed scroll 230 may be provided with an annular protrusion 232*g*, and a cover member 60 similar to that in the above embodiment may be placed on the fixed scroll 30 such that the inner surface of the cover member 60 comes in contact with the protrusion 232*g*. In this case, an intermediate-pressure first rear surface adjacent space S31*a* is formed on the inner side of the protrusion 232*g*, and a low-pressure second rear surface adjacent space S31*b* is formed on the outer side of the protrusion 232*g*. The fixed scroll 230 is similar to the fixed scroll 130 of Modification A except for the protrusion 232*g*.

Alternatively, the protrusion that partitions the first rear surface adjacent space S31*a* and the second rear surface adjacent space S31*b* may be provided on the cover member 60, not on the fixed scroll 230.

(5-3) Modification C

In the scroll compressor 100 of the above embodiment, the cover member 60 defines the intermediate-pressure rear surface adjacent space S3 that faces at least a part of the rear surface 32*b* of the intermediate- and low-pressure adjacent portion 33*b* in the compression chamber adjacent portion 33 of the fixed-side end plate 32. However, the present invention is not limited to this configuration.

Figure 7:
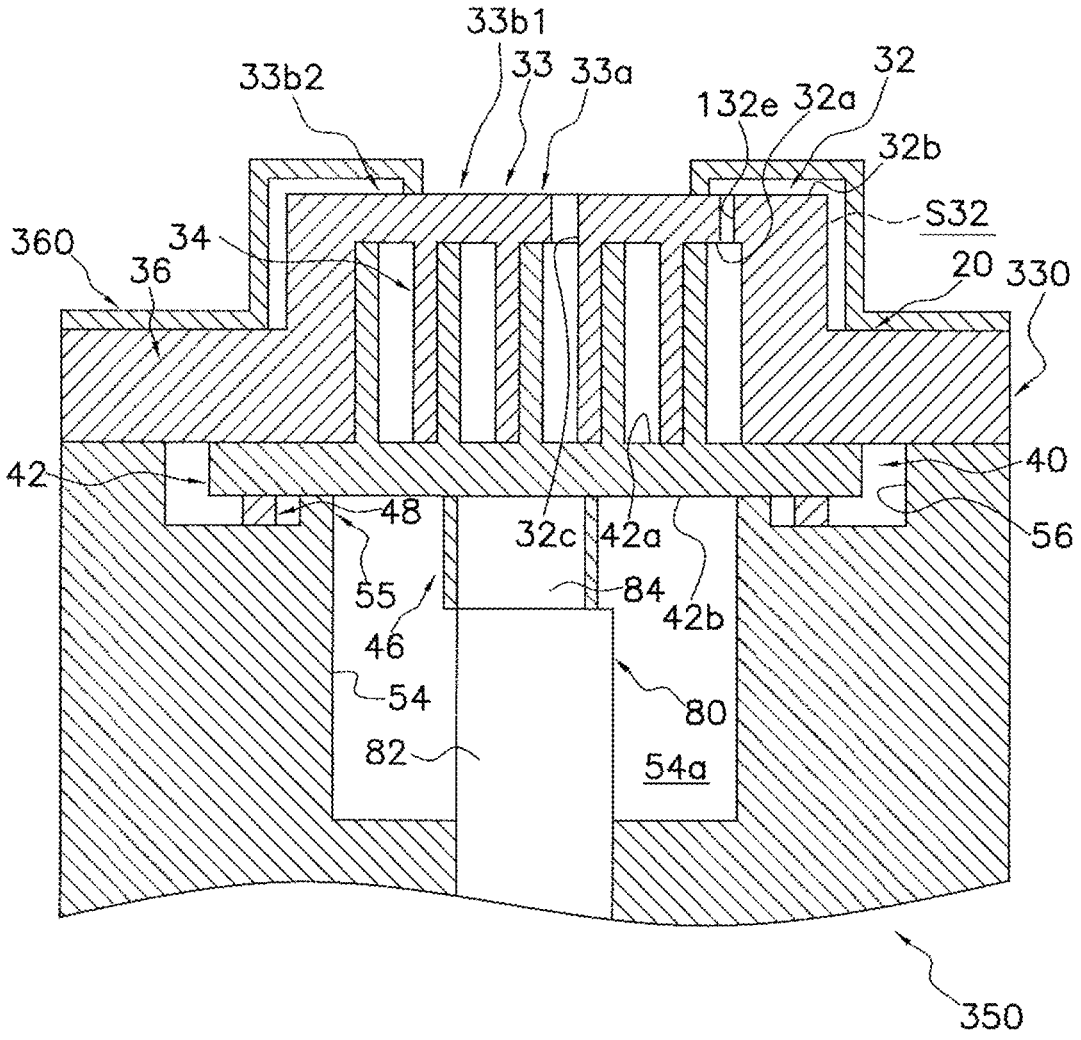
FIG. 7 is a schematic cross-sectional view illustrating the vicinity of a compression mechanism of a scroll compressor of Modification C.

For example, in the scroll compressor, as illustrated in FIG. 7, a cover member 360 may defines a rear surface adjacent space S32, and low-pressure gas refrigerant may be supplied to the rear surface adjacent space S32 through a through hole 132*e* provided in the fixed scroll, the through hole 132*e* being similar to that described in Modification A.

Preferably, such a low-pressure rear surface adjacent space S32 faces the low-pressure adjacent portion 33*b*2 in the compression chamber adjacent portion 33 of the fixed-side end plate 32, but does not face the intermediate-pressure adjacent portion 33*b*1. That is, the low-pressure rear surface adjacent space S32 (low-pressure rear surface adjacent space) is preferably disposed on the outer side of the intermediate-pressure adjacent portion 33*b*1 with reference to the central portion (high-pressure adjacent portion 33*a*) of the compression chamber adjacent portion 33 of the fixed-side end plate 32.

Here, the oil supply path is not formed in a fixed scroll 330 nor a housing 350. Alternatively, the oil supply path may be formed in the fixed scroll 330 and the housing 350 and low-pressure oil O may be supplied to the rear surface adjacent space S32 through the oil supply path, instead of allowing the rear surface adjacent space S32 to communicate with the low-pressure compression chamber Sc through the through hole 132*e* formed in the fixed scroll 330 as described in Modification A.

(5-4) Modification D

Although the rear surface adjacent space S3 is formed to face only with the rear surface 32*b* of the fixed-side end plate 32 in the above embodiment, the present invention is not limited to this configuration. Alternatively, the rear surface adjacent space S3 may face the fixed scroll in a wider range. For example, a rear surface adjacent space S3 that faces the side surface of the fixed scroll 330 may be formed, like the rear surface adjacent space S32 illustrated in FIG. 7.

(5-5) Modification E

In the above embodiment, the movable scroll 40 is driven by the motor 70. Alternatively, the scroll compressor 100 may be driven by a member other than the motor. For example, the scroll compressor may be driven by an engine.

(5-6) Modification F

In the above embodiment, the scroll compressor 100 has the high-pressure dome structure. Alternatively, the scroll compressor according to the present invention may have a so-called low-pressure dome structure. That is, for example, the scroll compressor may have such a configuration that low-pressure refrigerant is supplied to the second space S2 in which the motor 70 is disposed, the refrigerant is guided to the compression mechanism 20 and compressed, and the high-pressure refrigerant discharged from the compression mechanism 20 into the first space S1 flows to the outside through the discharge pipe provided at an upper part of the casing 10. Also in the scroll compressor having such a low-pressure dome structure, a configuration in which the cover member defines a rear surface adjacent space like the one described above such that the pressure difference between the front surface 32*a* and the rear surface 32*b* of the fixed-side end plate 32 is reduced, it is easy to reduce the reduction in efficiency of the scroll compressor caused by the increase in the tip gap and to reduce the overheating of compressed gas.

(5-7) Modification G

In the above embodiment, the scroll compressor 100 is a vertical scroll compressor in which the crankshaft 80 extends in the vertical direction. However, the present invention is not limited to this configuration. The scroll compressor according to the present invention may be a horizontal scroll compressor.

(5-8) Modification H

In the above embodiment, the intermediate-pressure back pressure space S4 is provided around the crank chamber 54*a*. However, the present invention is not limited to this configuration. For example, the back pressure space S4 according to the above embodiment may be a low-pressure space, without forming the communication groove 36*a* in the peripheral edge portion 36 of the fixed scroll 30 and the communication hole 42*c* in the movable-side end plate 42 of the movable scroll 40.

(5-9) Modification I

In the above embodiment, the cover member 60 defines the annular rear surface adjacent space S3. However, the present invention is not limited to this configuration. For example, the cover member 60 may define one or more rear surface adjacent spaces that are discontinuous in the circumferential direction. However, the rear surface adjacent space is preferably an annular space in order to suppress the deformation of the fixed-side end plate 32 of the fixed scroll 30 over the entire circumference.

INDUSTRIAL APPLICABILITY

The present invention is widely applicable to a scroll compressor in which a high-pressure space is disposed on a rear surface side of a fixed-side end plate.

REFERENCE SIGNS LIST

24 Oil supply path
30, 130, 230, 330 Fixed scroll
32 Fixed-side end plate
32*a* Front surface of fixed-side end plate
32*b* Rear surface of fixed-side end plate
32*d* Oil passage
33 Compression chamber adjacent portion
33*a* High-pressure adjacent portion
33*b* Intermediate- and low-pressure adjacent portion
33*b*1 Intermediate-pressure adjacent portion
33*b*2 Low-pressure adjacent portion
34 Fixed-side wrap
40 Movable scroll
42 Movable-side end plate
42*a* Front surface of movable-side end plate
44 Movable-side wrap
60, 160, 360 Cover member
62*b* Communication hole
68 Relief valve
100 Scroll compressor
Sc Compression chamber
S1 First space (high-pressure space)
S3, S31 Rear surface adjacent space
S31*a* First rear surface adjacent space
S31*b* Second rear surface adjacent space (low-pressure rear surface adjacent space)
S32 Rear surface adjacent space (low-pressure rear surface adjacent space)

CITATION LIST

Patent Literature

<Patent Literature 1> JP 2003-206873 A

The invention claimed is:

1. A scroll compressor comprising:

a fixed scroll including a fixed-side end plate having a flat plate shape and a fixed-side wrap having a spiral shape and protruding from a front surface of the fixed-side end plate;

a movable scroll including a movable-side end plate having a flat plate shape and a movable-side wrap having a spiral shape and protruding from a front surface of the movable-side end plate, the movable-side wrap being combined with the fixed-side wrap to form a compression chamber; and a cover member disposed in a high-pressure space on a rear surface side of the fixed-side end plate and attached to the fixed scroll, the fixed-side end plate including a compression chamber adjacent portion at which the front surface of the fixed-side end plate faces the compression chamber, the compression chamber adjacent portion including a high-pressure adjacent portion disposed at a central portion of the compression chamber adjacent portion and at which the front surface of the fixed-side end plate faces the compression chamber having a high pressure, and an intermediate- and low-pressure adjacent portion disposed on an outer side of the high-pressure adjacent portion, the cover member defining a rear surface adjacent space having a low or intermediate pressure that faces at least a part of a rear surface of the intermediate- and low-pressure adjacent portion in the compression chamber adjacent portion of the fixed-side end plate, the scroll compressor further comprising an oil supply path through which oil having an intermediate pressure is supplied to the rear surface adjacent space, an oil passage that guides the oil in the rear surface adjacent space to the compression chamber being formed in the fixed-side end plate, and the oil supply path communicating between a space in which high-pressure oil is stored and the rear surface adjacent space and including a narrower portion that has smaller flow path area than an other portion of the oil supply path to supply intermediate pressure oil decompressed at the narrower portion to the rear surface adjacent space.

2. The scroll compressor according to claim 1, further comprising:

a relief valve that is attached to the cover member to close a communication hole formed in the cover member and allowing the high-pressure space to communicate with the rear surface adjacent space, the relief valve being configured to open when a pressure in the rear surface adjacent space rises above a predetermined pressure.

3. The scroll compressor according to claim 2, wherein the intermediate- and low-pressure adjacent portion includes a low-pressure adjacent portion at which the front surface of the fixed-side end plate faces the compression chamber having a low pressure, and the rear surface adjacent space faces at least a rear surface of the low-pressure adjacent portion.

4. The scroll compressor according to claim 2, wherein the intermediate- and low-pressure adjacent portion includes an intermediate-pressure adjacent portion at which the front surface of the fixed-side end plate faces the compression chamber having an intermediate pressure, the rear surface adjacent space includes at least a low-pressure rear surface adjacent space having a low pressure, and the low-pressure rear surface adjacent space is disposed on an outer side of the intermediate-pressure adjacent portion with reference to the central portion of the compression chamber adjacent portion.

5. The scroll compressor according to claim 2, wherein the rear surface adjacent space includes:

a first rear surface adjacent space having an intermediate pressure; and a second rear surface adjacent space having a low pressure and disposed on an outer side of the first rear surface adjacent space with reference to the central portion of the compression chamber adjacent portion.

6. The scroll compressor according to claim 5, wherein the intermediate- and low-pressure adjacent portion includes:

a low-pressure adjacent portion at which the front surface of the fixed-side end plate faces the compression chamber having a low pressure; and an intermediate-pressure adjacent portion at which the front surface of the fixed-side end plate faces the compression chamber having an intermediate pressure, the first rear surface adjacent space faces a rear surface of the intermediate-pressure adjacent portion, and the second rear surface adjacent space faces a rear surface of the low-pressure adjacent portion.

7. The scroll compressor according to claim 2, wherein the rear surface adjacent space has a volume smaller than a volume of the high-pressure space.

8. The scroll compressor according to claim 2, wherein the cover member defines the rear surface adjacent space having an annular shape.

9. The scroll compressor according to claim 1, wherein the intermediate- and low-pressure adjacent portion includes a low-pressure adjacent portion at which the front surface of the fixed-side end plate faces the compression chamber having a low pressure, and the rear surface adjacent space faces at least a rear surface of the low-pressure adjacent portion.

10. The scroll compressor according to claim 1, wherein the intermediate- and low-pressure adjacent portion includes an intermediate-pressure adjacent portion at which the front surface of the fixed-side end plate faces the compression chamber having an intermediate pressure, the rear surface adjacent space includes at least a low-pressure rear surface adjacent space having a low pressure, and the low-pressure rear surface adjacent space is disposed on an outer side of the intermediate-pressure adjacent portion with reference to the central portion of the compression chamber adjacent portion.

11. The scroll compressor according to claim 1, wherein the rear surface adjacent space includes:

a first rear surface adjacent space having an intermediate pressure; and a second rear surface adjacent space having a low pressure and disposed on an outer side of the first rear surface adjacent space with reference to the central portion of the compression chamber adjacent portion.

12. The scroll compressor according to claim 11, wherein the intermediate- and low-pressure adjacent portion includes:

a low-pressure adjacent portion at which the front surface of the fixed-side end plate faces the compression chamber having a low pressure; and an intermediate-pressure adjacent portion at which the front surface of the fixed-side end plate faces the compression chamber having an intermediate pressure, the first rear surface adjacent space faces a rear surface of the intermediate-pressure adjacent portion, and the second rear surface adjacent space faces a rear surface of the low-pressure adjacent portion.

13. The scroll compressor according to claim 1, wherein the rear surface adjacent space has a volume smaller than a volume of the high-pressure space.

14. The scroll compressor according to claim 1, wherein the cover member defines the rear surface adjacent space having an annular shape.

* * * * *